US005223272A

United States Patent [19]

Pringle

[11] Patent Number: 5,223,272

[45] Date of Patent: Jun. 29, 1993

[54] APPARATUS FOR REPAIRING CRACKED WALLS

[76] Inventor: Ronald Pringle, P.O. Box 635, Manhattan Beach, Calif. 90266

[21] Appl. No.: 611,027

[22] Filed: Nov. 9, 1990

[51] Int. Cl.[5] ..... B29C 45/03

[52] U.S. Cl. ..... 425/12; 156/94; 264/36; 425/13; 425/14

[58] Field of Search ..... 52/514, 744; 425/11, 425/12, 13, 14; 264/36; 156/94; 99/280

[56] References Cited

U.S. PATENT DOCUMENTS

| | | | |
|---|---|---|---|
| 1,883,196 | 10/1932 | Wertz | 264/36 |
| 3,557,563 | 1/1971 | Stevens | 264/36 |
| 3,651,203 | 3/1972 | Massonnet | 425/13 |
| 4,597,727 | 7/1986 | Birkhauser, III | 425/12 |
| 4,872,403 | 10/1989 | LaGesse et al. | 99/280 |
| 5,063,006 | 11/1991 | Tahara | 264/36 |

*Primary Examiner*—Tim Heitbrink
*Attorney, Agent, or Firm*—Lyon & Lyon

[57] ABSTRACT

A method of repairing cracks in brick walls by drilling spaced apart injection ports into the crack. Verification ports are drilled generally in alignment with the injection ports on each side of the crack. The wall is saturated with water and grout is injected into the injection ports until a limiting pressure is reached or until grout begins to flow from the verification ports. An apparatus for repairing cracked brick walls includes a grout delivery tube having a nozzle and an expandable sleeve to seal to the tube within injection ports. Valves and a grout circulation loop control the injection of grout from the delivery tube.

11 Claims, 4 Drawing Sheets

APPARATUS FOR REPAIRING CRACKED WALLS

BACKGROUND OF THE INVENTION

The invention relates a method and apparatus for repairing and reinforcing walls having cracks and other structural defects.

Damage to unreinforced brick buildings caused by earthquakes includes cracks through brick walls due to horizontal offset in the plane of the wall. These cracks generally do not represent hazardous or unstable conditions, but rather weakening that, in future earthquake shaking could lead to further cracking and hazardous instability or loss of bricks from the wall. Engineers evaluating earthquake damaged buildings often find obviously repairable damage such as fallen parapets and partial separations of framing from bearing walls. However, cracks in brick walls have not been easily evaluated for repairability, and previously no economical, structurally effective, and aesthetically acceptable repair method has been known.

A prior art method of crack repair is removal of bricks adjacent to the crack and resetting them along with a reinforcing bar parallel to the crack in new mortar. However, this method can only address the exposed wythes. It also risks the probability of propagating cracks and loosening bricks above the repair as support is taken away by the removal process. There is also probability of damage to the wall adjacent to header bricks that must be removed or broken. Moreover, this prior art method installs tensile capacity oriented at right angles to the tensile force that caused the crack, and it is a very labor intensive method.

Accordingly, it is an object of the invention to provide a novel method and apparatus for repairing brick walls.

SUMMARY OF THE INVENTION

To this end, an apparatus for repairing walls includes a grout delivery tube having nozzle and an expandable sleeve adjacent to the nozzle. A lever mechanism is provided to expand and contract the expandable sleeve and a valve controls grout flow through the delivery tube. A preset pressure switch is advantageously included to limit the flow of grout after a certain pressure is reached.

Also to this end, a method of repairing a wall includes the steps of drilling a plurality of spaced apart injection ports into or through the crack. Verification ports are also drilled into the wall on one or both sides of the crack. The wall is saturated with water 24 hours before the injection process and again immediately before the injection process. The saturation commences at the top of the wall. A grout injector is inserted into the lowermost injection port. The injector is sealed against the injection port to prevent grout from back-flowing out of the injection port. Grout is injected into the injection port through the injector until grout flows out of adjacent verification ports. The injector is unsealed and removed from the injection port and the injection port and verification ports may be plugged. The wall may be sealed with an approved sealer and washed to prevent staining. Verification ports that do not show grout outflow can be separately injected with grout.

In walls having several collar joints, the injection sequence is started with the innermost collar joint and is then repeated for the succeeding collar joints by withdrawing the injector to the next collar joint.

BRIEF DESCRIPTION OF THE DRAWINGS

In the drawings, wherein similar reference characters denote similar elements throughout the several views.

DETAILED DESCRIPTION OF THE PREFERRED EMBODIMENT

Observation of existing unreinforced brick construction has revealed that a system of interconnected voids is nearly universally found in unreinforced brick buildings. It has been discovered that the void system can successfully be used as conduit for grout to travel in the wall in the vicinity of cracks.

Figure 1:
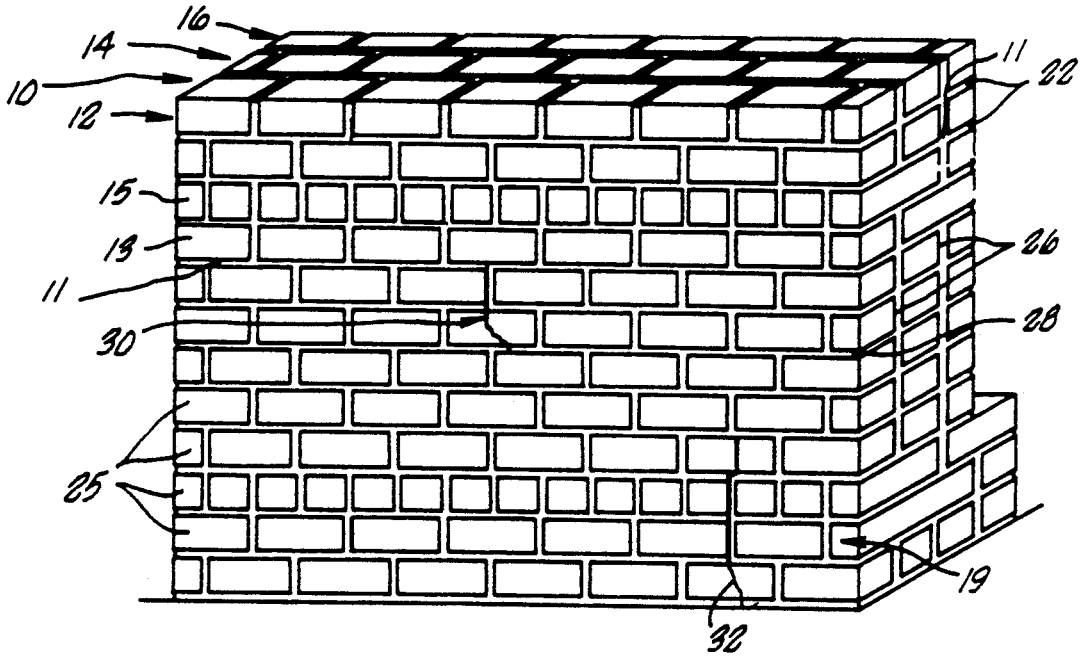
FIG. 1 is a perspective view of a cracked brick wall.
Figure 6:
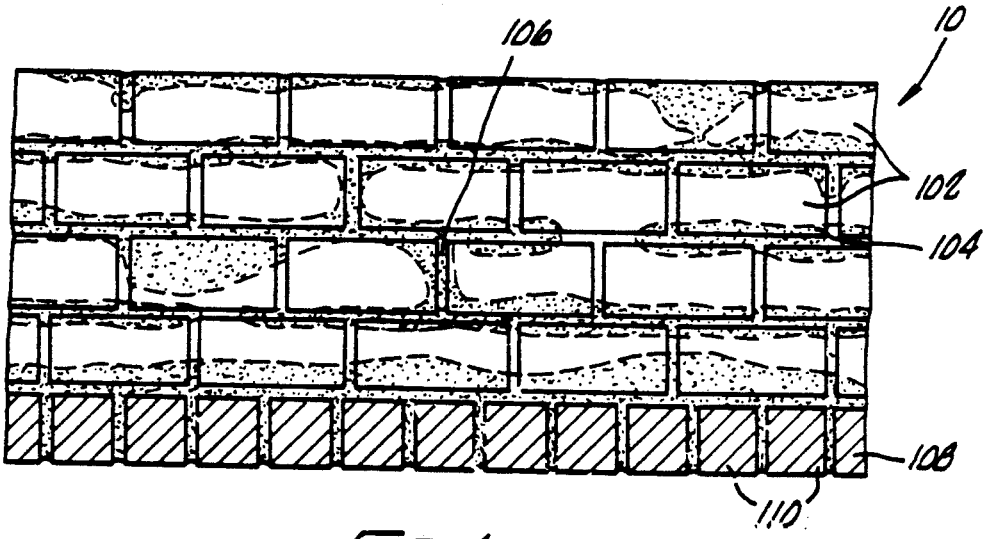
FIG. 6 is a front elevation view of mortar in a typical collar joint of a brick wall.

FIG. 1 shows the details of construction of a typical unreinforced brick masonry wall and a typical in-plane crack pattern. In the wall 10, courses of bricks, e.g., 13 and 15, are separated by bed joints 22 of hardened mortar. Bricks in a course are separated by head joints 28. Bed joints 22 are usually found to be full of mortar 11. Head joints 28 may be full, but sometimes are partially filled with mortar 11 only at the outside face 19 of the wall 10. Wythes 12, 14 and 16 are separated by collar joints 26. Collar joints 26 commonly contain only mortar 11 that was squeezed out of the bed joints 22 as the bricks 25 were set and tapped into place. The remaining volume of the collar joint 26 is empty or hollow, forming the interconnecting system of voids 10 that makes grout injection feasible (FIG. 6 phantom lines). Arches and masonry with exceptional workmanship may have nearly full collar joints where effort was made to fill them. Even in such cases, however, 100% filling is not likely as the filling had to be accomplished by tucking the mortar into the collar joints by the point of the trowel, and voids generally cannot be avoided.

In-plane cracks generally follow the mortar joints with bricks sliding horizontally on bed joints 22 and separating across head joints 28. Occasionally the crack 30 will propagate through the bricks 25, resulting in cracked bricks 32.

Figure 3:
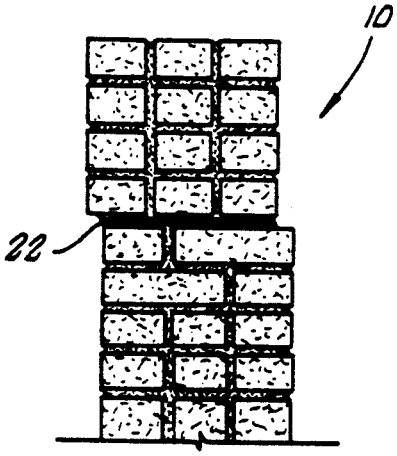
FIG. 3 is a fragment end view of a wall illustrating sliding on one bed joint.
Figure 4:
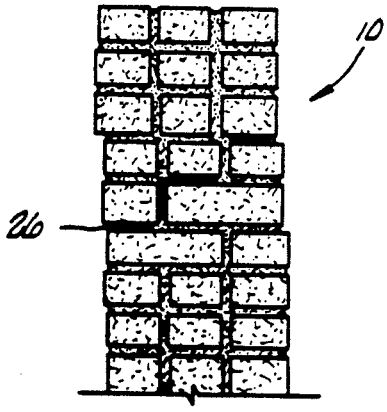
FIG. 4 is a fragment end view of a wall illustrating sliding on adjacent bed joints.
Figure 5:
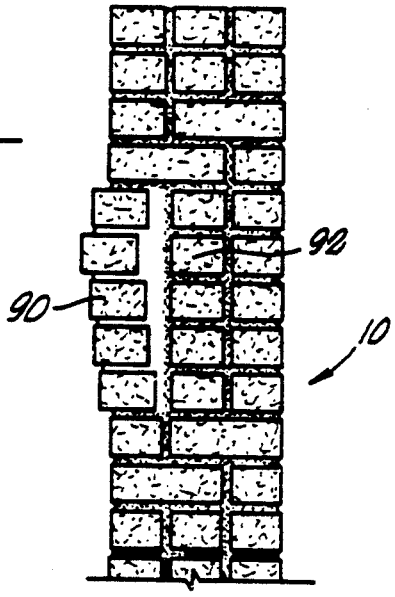
FIG. 5 is a fragment end view of a wall illustrating wythe separation (out-of-plane crack)

Out-of-plane cracks occur with bricks sliding horizontally on bed joints 22 and separating across collar joints 26, as shown in FIGS. 3 and 4. FIG. 5 shows wythe separation with the first or facing wythe 90 moved away from the adjacent wythe 92.

Figure 2:
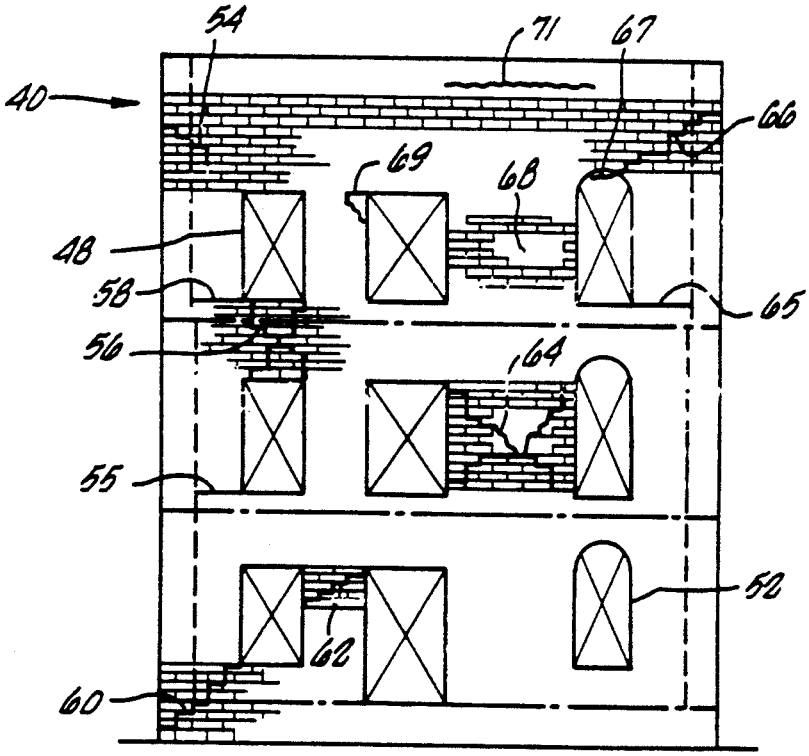
FIG. 2 is a schematically illustrated front elevation view of a wall of a brick building having various cracks.

FIG. 2 illustrates a typical unreinforced brick masonry building wall and crack patterns commonly observed in such a wall after an earthquake. Crack 54 is a horizontal separation of the upper corner pier from the upper spandrel. It indicates that there was relative movement between the corner pier and the rest of the wall 40. If there are no cracks similar to crack 56, the corner pier probably rocked outward from the wall on a horizontal crack at the sill of the upper story window 48. If cracks in the end spandrel similar to 56 exists, rocking of the corner pier at a lower level, for example as at crack 55 is likely. Cracks at 55 and 58 may not be visible as they may be tightly closed by gravity.

The combination of cracks 54 and 58, or 54, 56 and 55 are very commonly observed earthquake damage. These types of cracks appear to be caused by the corner pier being able to rock away from the building on a horizontal crack near the base of the pier, but being unable to rock toward the building because of the weight of the adjacent wall around the corner. Often, an aggravating cause of this system of cracks is lack of shear anchorage between the diaphragms and the wall 40. Without shear anchorage to force the diaphragms to move with the wall as it is shaken in-plane by ground motion, impact of the adjacent wall around the corner at each end of the wall with unrestrained diaphragms can be a cause of the cracking. Because the adjacent wall around the corner may have been forced outward with the corner pier, the length of bearing or framing members on adjacent wall may have been reduced.

Cracks 65 and 66 are similar to cracks 54 and 58. When the corner pier is adjacent to an opening with an arched lintel, the outward thrust of the arch can add to the forces that tend to push the corner pier outward. When the pier rocks outward, a part of the arch may fall as at crack 67.

Crack 69 indicates at downward displacement of the upper part of the jamb directly under the lintel. It is caused by the high bearing stresses under ends of the lintels added to the compressive forces that develop in the pier corners due to rocking of the pier caused by in-plane shear forces during earthquake shaking.

Cracks in piers with an X configuration, such as crack 64, are diagonal tension cracks that follow the mortar joints (which are generally planes of lower strength in the non-isotropic masonry construction). Bricks have slid horizontally on bed joints, separating across head joints. Often there will be several adjacent head joint separations in a single course, especially if the horizontal offset across the X crack is large, indicating that there are bricks that are completely debonded from the wall. Such debonded bricks may be found to have moved out of plane or even fallen out of the wall.

Cracks 60 and 62 may be settlement cracks not necessarily related to earthquake shaking, or may have been existing cracks aggravated by earthquake shaking.

Crack 71 is an out-of-plane crack. A portion of the wall has moved in a direction perpendicular to the plane of the wall. The crack 71 may have occurred by sliding on one bed joint (as in FIG. 3) or adjacent wythes may have slid on different bed joints (as in FIG. 4) widening the collar joints adjacent to the crack. This type of crack 71 is observed most commonly near the tops of walls where there is little bed laid above to develop frictional resistance to sliding. Anchorage of the wall to a sloped diaphragm can contribute to this kind of crack if the anchors do not extend downwardly into the wall far enough to engage a mass of wall with sufficient weight to resist the vertical component of the anchorage force that develops during earthquake shaking.

Crack 68 is an out-of-plane crack due to a wythe separation. A portion of the exterior wythe has moved outwardly, widening the collar joint behind it (FIG. 5). It can be caused by impact of the wall with some rigid element adjacent to the wall on the inside, such as a partition, a ceiling, or the end of a beam or truss. Near mid-height of the wall, it is likely to be due to inertial forces related to out-of-plane response of the wall in combination with poor quality mortar in the bed joints, and poor quality mortar, or lack of mortar, in the collar joint.

Referring to FIG. 6, an interconnected system of voids 102 in the collar and head joints allows the present injection process to force fluid grout into the crack. FIG. 6 shows a view of a collar joint in the interior of a brick wall and a typical system of voids 102 in a collar joint. Generally, the voids 10 in the collar and head joints allow grout to flow well beyond the crack and to make contact with the adjacent bricks. The grout hardens and bonds loosened bricks into the wall and restores strength lost when the original bond of mortar to brick was lost due to cracking. Blocks 110 form a header course. The void system is occasionally blocked by a full collar joint 106. Mortar 104 may be squeezed out of the bed joint.

The present method is suitable for repairing various types of cracks. Referring once again to FIG. 2, cracks 54 and 66 can be repaired by the present crack injection process. In addition to repair of the crack itself, framings supported on the adjacent wall around the corner should be investigated for loss of or reduction of support, and appropriate repairs made. Preferably, the shear connection of the diaphragms to the wall will also be made.

Crack 56 can also be repaired by the present injection process. A steel lintel at the top of the opening will prevent injection into the full wall thickness adjacent to the beam if injection is done from only one side of the wall. Cracks 58, 55, and 65 will generally be closed by gravity and cannot receive injected grout. Grout can be used to fill the collar joints adjacent to the crack and bond adjacent loosened bricks. Crack 67 generally cannot be repaired by injection. Arches generally are built with special effort to completely fill collar and head joints. Voids are small and not interconnected so that the injection process is not generally effective. An arch with loose bricks or with a part of the arch badly displaced downward should ordinarily be rebuilt.

Referring still to FIG. 2 cracks 69 do not have the typical pattern following bed and head joints. The loosened portion is separated from the wall along a diagonal line that has sheared through bricks. Restoration of support for the lintel requires that the corners of the pier be reconstructed after removal of the damaged bricks. Cracks 64, if about ½ inch wide or less can often be repaired by the present injection method. Grout cannot be injected into the bed joints of the crack to restore the original resistance to sliding, but continuity of grout in the voids of the collar joints will supplement the frictional sliding resistance that remains. Where there are several head joint separations in a course, the injection of grout effectively restores bond of the loose bricks into the wall. If the cracks are wide, damage to lintel bearings may have occurred, and grout injection may not adequately repair them. Cracks 60 and 62 are potentially refillable by the present grout injection process. However, the cause of these cracks should be investigated, and repaired along with the injection work.

Crack 71, an out-of-plane crack, should be investigated to determine the configuration of the crack through the wall. If the offset occurred on a single bed joint, injected grout probably cannot flow across the collar joint blocked by the offset. In that case, it will be necessary to remove and reset bricks adjacent to the crack on each side of the wall to provide for continuity of grout in the collar joints across the bed joint. If the sliding planes are on different bed joints, good flow of grout into the collar joint at the crack will assure effective bonding by the grout.

Crack 68 can be effectively repaired by the present method by filling the void behind the offset bricks with injected grout. If the area of the offset wythe is large, the injected pressure may have to be reduced to prevent a bulge or blowout.

In preparation for performing the present injection method, loose mortar and mortar easily debonded are completely removed from the open joints. The mortar typically found in unreinforced masonry is soft and easily abraded in comparison with modern mortar. Workmen should learn the nature of the typical undamaged mortar in the wall and the level of care required to protect it before setting out to look for easily debonded mortar in the joints. The crack is then cleaned by flushing with water, and filled with mortar to a depth of about ½ inch. The depth of filing with mortar should be no more than is required to confine the injected grout leaving as much void as possible for the grout to fill. The mortar is tooled to match the adjacent bricks. Bricks that can be removed by hand are removed from the wall and reset in new mortar.

Figure 7:
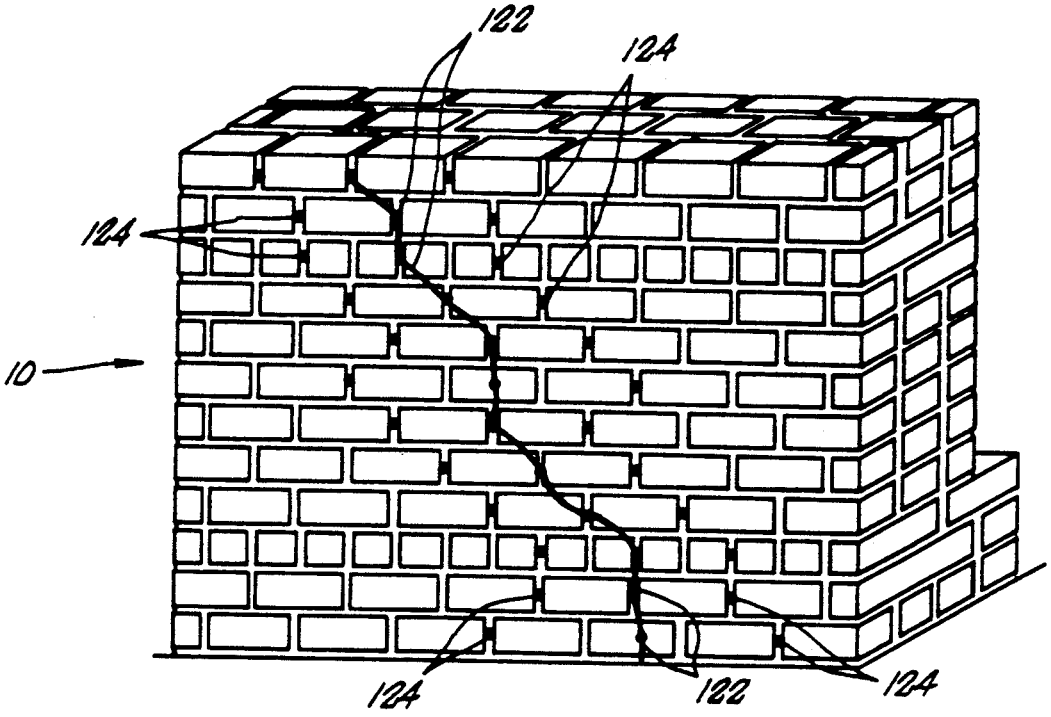
FIG. 7 is a perspective view of a brick wall generally illustrating the method of the invention.
Figure 8:
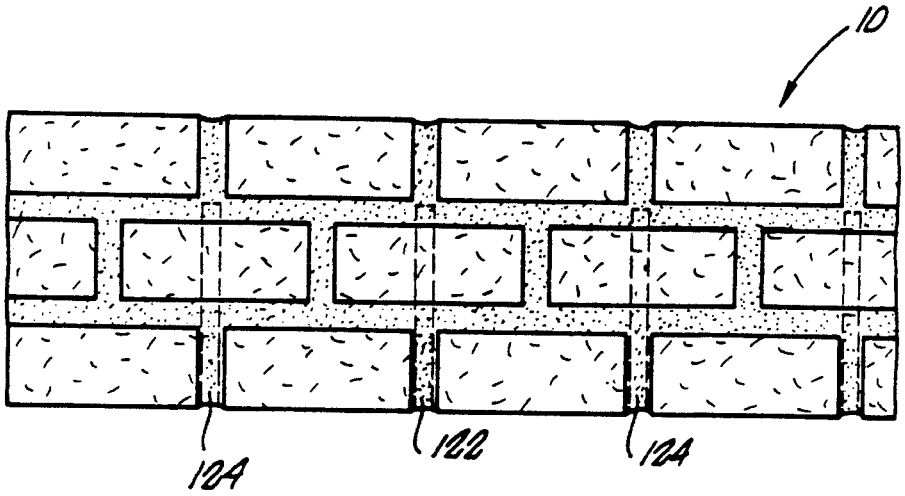
FIG. 8 is a top elevation view fragment of the wall of FIG. 7.

As shown in FIG. 7, holes for injecting grout (injection ports 122) and for verification of flow (verification ports 124) are drilled into and adjacent to the crack. A typical pattern of holes for injection is shown in FIG. 7. The holes are drilled to the depth of the near face of the far wythe, as shown in FIG. 8. Typically, the verification ports are drilled 8 to 10 inches on each side of each injection port 122.

The crack and ports are then thoroughly flushed with water to clean and saturate the wall. Flushing begins at the top of the wall and works downwardly. Each injection and verification port is flushed with water until the water runs clean from adjacent holes. The flushing is preferably done twice, once 24 hours before injection begins, and again immediately before injection. Flushing is repeated if more than 2 hours elapses between flushing and injection to maintain saturation of the wall.

Grout is injected into the wall through an injection tool or wand. Injection starts from the far collar joint and proceeds to the near collar joint, progressing from bottom to top. Verification ports are plugged as grout flows from them. Spillage must be washed from wall as it occurs, to prevent staining. When the grout is firm, plugs are removed from the ports and they are pointed with mortar tooled to match the adjacent joints. It has been found that a pressure of 30 psi is generally adequate to achieve a lateral grout flow of 2 or 3 feet in each side of the crack. Verification ports are used to assure that flow at least equal to the length of a brick on each side of the crack is indicated. Occasional mortar blockages in collar joints will isolate an injection or verification port from the system of voids that is being filled with grout. In this case, verification ports that do not show grout flow are also separately injected.

The grout must have the following characteristics:

Slow setting to maintain fluidity for the time required to mix and inject a batch into the wall.

Highly water retentive to remain fluidity during flow past brick masonry which tends to be highly absorbive, even when wet.

Good bond to existing brick and mortar.

Low shrinkage to prevent internal cracking and breaking of bond.

Moderate strength of least equal to or better than the existing construction.

Low cost since voids in the wall tend to allow large quantities of grout to flow far beyond the zone need repair.

In the hardened state, somewhat pervious to passage of water vapor through the wall to prevent moisture from accumulating in the wall at an impervious membrane surface. The grout mix shown in Table 1 produces a grout that has a slow setting rate and high water retention due to the lime; has excellent fluidity due to the fine aggregate and the lubricating qualities of fly ash and plasticizing agents of the plastic cement; bonds to brick better than the original mortar; has insignificant shrinkage; has a compressive strength of about 1200 psi, which is stronger than the original lime mortar; uses low cost, readily available materials; and is a cementicous material having permeability qualities compatible with the original construction.

TABLE 1

| Group Recipe Parts measured by volume | | | | |
|---|---|---|---|---|
| Silica Sand | | Plastic | Type S | Type F |
| #60 | #90 | Portland Cement | Lime | Fly Ash |
| 3 | 1 | 1 | ½ | ½ |

About 17½ gallons of water are added with parts in cubic feet. A simple puddle diameter flow test is used to test consistency.

Figure 9:
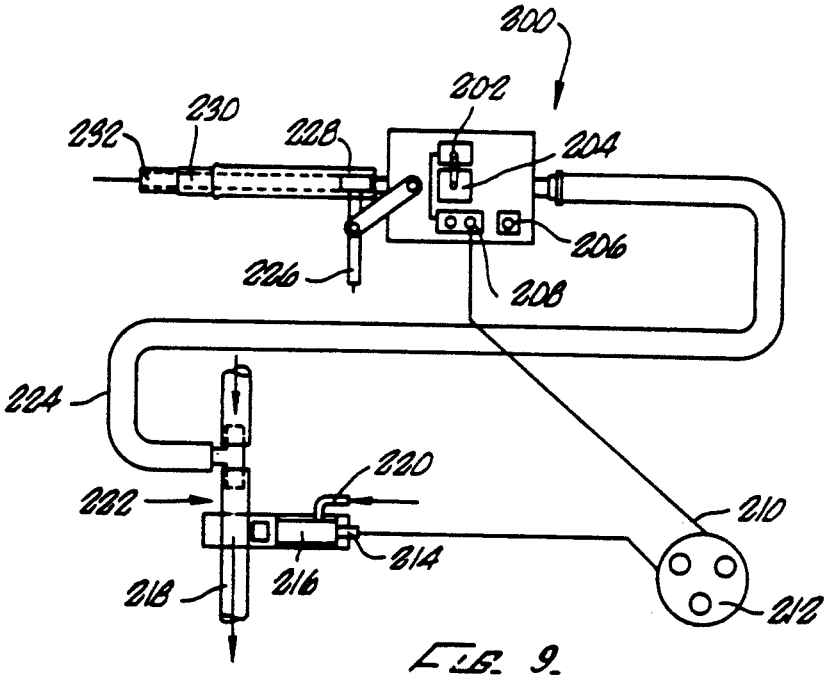
FIG. 9 is schematic illustration of the apparatus of the invention.
Figure 10:
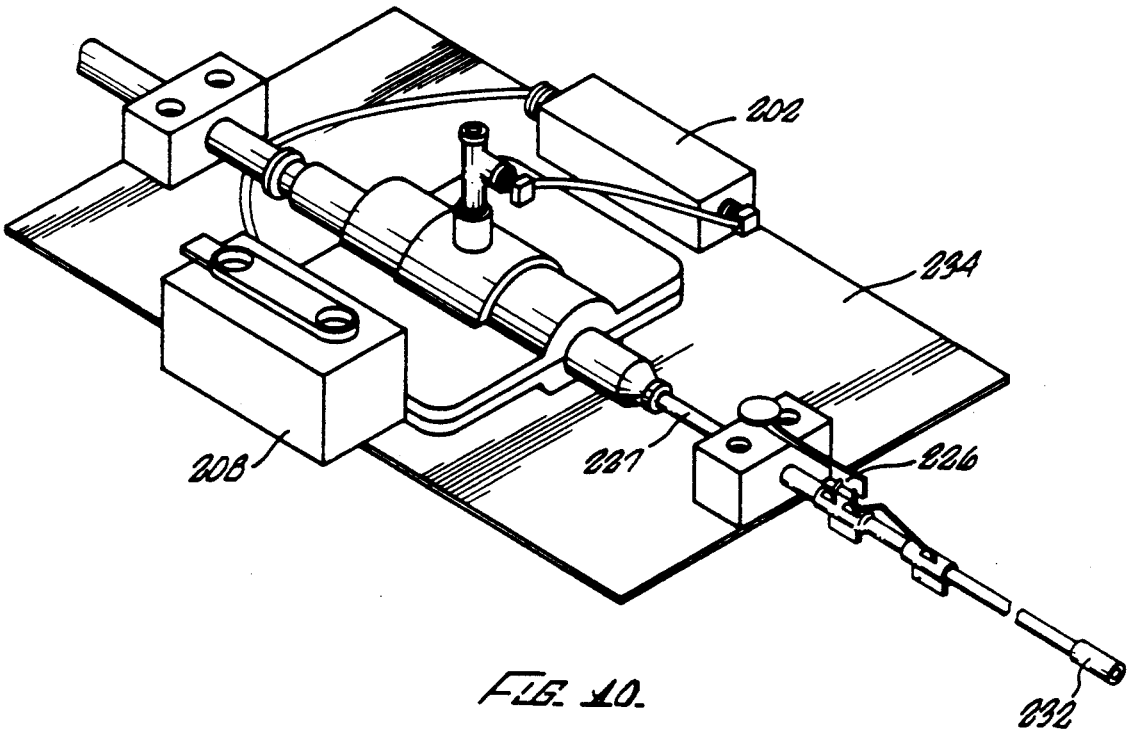
FIG. 10 is a perspective view thereof.

As shown in FIGS. 9 and 10, the injection tool or wand 200 is a hand-held device with mechanical and electrical controls. Grout is delivered from a delivery hose 224 from a pump (not shown) to the tool 200 for injection into the wall. The grout is made in a mixer and transferred to a pump that feeds a continuous circulation loop or hose 218. Grout is delivered by the delivery hose 224 from the circulation loop and ultimately to the injection nozzle 232. A flow indicator light 206 on the wand allows the operator to monitor the flow from the diversion unit 222. A remote indicator unit 212 is electrically linked to the wand by a control/indicator cable 210 and includes indicator lights that allow monitoring by inspection and supervisory personnel.

The wand includes a handle 226 attached to a base 234 and engaged to a sliding steel tube 228 surrounding the grout delivery tube 227 and nozzle 232. Actuation of the handle 226 causes the tube 228 to slide forward and expand and bulge at the rubber expansion sleeve 230, to seal the grout delivery tube against the inside surfaces of an injection port.

The diversion unit 222 includes a solenoid 214 and a pneumatically operated ram 216 connected to a compressed air line 220 for opening and closing the grout circulation loop 218. The grout circulation loop is squeezed or pinched shut by the ram, causing grout to flow through the delivery hose during grout injection. When grout is not being injected, the hydraulic ram 216 is released from the circulation loop 218 and grout flows in a loop through the circulation loop 218. The grout pump (not shown) operates continuously.

To operate the injector or wand, the nozzle 232 is inserted fully into an injection port. It is then pulled back approximately one inch to place the rubber expansion sleeve 230 out of the collar joint and between masonry units or bricks. The expansion sleeve handle 226 is then pulled by the operator to expand the expansion sleeve 230 sealing the injection port around the grout delivery tube in order to minimize backflow around the tube. To begin flow, the control switch 208 is pressed thereby operating the diversion unit 222 (i.e., causing the ram 216 to pinch shut the grout circulation loop 218), such that grout then flows under pressure into the delivery hose, out of the nozzle 232 and into the wall. Grout continues to flow into the wall until it is automatically shut off by the pressure switch 204 which is preferably set to 30 psi. Alternatively, the operator may manually activate an override switch 202 to stop the flow, after observing grout flowing from verification ports on at least 3 courses above the injection level (thereby indicating that injection is completed). The handle 226 is then released allowing the expansion sleeve 230 to contract and the delivery tube is withdrawn about 4 inches to address the next collar joint. The procedure is repeated for each collar joint of each injection port, and for verification ports from which no grout flows.

The present method and apparatus may be used for embedment of anchor bolts and deeply embedded reinforcing bars into unreinforced brick walls. It is also useful for bonding of existing of unbonded masonry veneers to the structural wall as part of an earthquake hazard reduction program. Veneer separation is a commonly observed damage to unreinforced brick buildings. Grout injected into the collar joint between the veneer and the structural wall appears to be an effective means of preventing veneer separation during earthquake shaking. Masonry sealers may potentially be applied to a wall before beginning work to prevent stains by grout spills which are not immediately cleaned. However, the effect of such sealers on permeability characteristics of the wall should be considered.

Thus, a method and apparatus for repairing cracked walls is disclosed which employs grout injection. While embodiments and applications of this invention have been shown and described, it would be apparent to this skilled in the art that many more modifications are possible without departing from the inventive concepts herein. The invention, therefore, is not to be restricted except in the spirit in the appended claims.

What is claimed is:

1. An apparatus for repairing walls comprising:
a grout delivery tube having a nozzle;
an expandable sleeve adjacent said nozzle;
means for reversably expanding said expandable sleeve;
means for controlling grout flow through said delivery tube.

2. The apparatus of claim 1 further comprising a preset pressure switch.

3. The apparatus of claim 1 further comprising a pressure sensor.

4. The apparatus of claim 1 further comprising a flow indicator light.

5. The apparatus of claim 1 further comprising a grout diversion unit.

6. The apparatus of claim 1 wherein the expandable sleeve is rubber.

7. An apparatus for repairing wall comprising:
a grout delivery tube having a nozzle;
an expandable sleeve adjacent said nozzle;
means for reversably expanding said expandable sleeve including a handle linked to a tube slidably disposed around said delivery tube; and
means for controlling grout flow through said delivery tube.

8. An apparatus for reinforcing walls comprising:
a grout delivery tube having a nozzle;
an expandable rubber sleeve substantially surrounding said grout delivery tube adjacent said nozzle;
means for expanding and contracting said expandable sleeve; and
a valve for controlling grout flow through said delivery tube.

9. The apparatus of claim 8 further comprising a remote indicator unit electrically linked to the apparatus.

10. The apparatus of claim 8 further comprising a pressure sensor linked to the valve.

11. An apparatus for repairing brick walls comprising:
a circulation loop for containing continuously circulating grout;
a diversion unit associated with the circulation loop;
a delivery hose joined to the circulation loop;
a grout injector including a grout delivery tube having a nozzle, an expandable sleeve adjacent the nozzle, means for reversably expanding the sleeve, and a valve for controlling flow of a grout through the delivery tube, with the grout delivery tube joined to the delivery hose and the valve including a switch electrically linked to the diversion unit.

* * * * *